US006971540B1

(12) United States Patent
Przytulla et al.

(10) Patent No.: US 6,971,540 B1
(45) Date of Patent: Dec. 6, 2005

(54) PLASTIC CONTAINER

(75) Inventors: Dietmar Przytulla, Kerpen (DE); Wilhelm Peter Meuleman, Oosterhout (NL)

(73) Assignee: Mauser-Werke GmbH & Co. KG, Brühl (DE)

( * ) Notice: Subject to any disclaimer, the term of this patent is extended or adjusted under 35 U.S.C. 154(b) by 699 days.

(21) Appl. No.: 09/525,526

(22) Filed: Mar. 15, 2000

(30) Foreign Application Priority Data

Apr. 22, 1999 (DE) ..... 299 07 189 U

(51) Int. Cl.[7] ..... B65D 6/38
(52) U.S. Cl. ..... 220/669; 215/382; 220/672
(58) Field of Search ..... 220/669, 672, 220/675, 601, 604–606, 656–659, DIG. 1; 215/382

(56) References Cited

U.S. PATENT DOCUMENTS 3,117,873 A * 1/1964 Bartels et al. ..... 426/131
3,586,204 A * 6/1971 Roper ..... 220/200
3,780,899 A * 12/1973 Roper ..... 220/4.04
3,985,257 A * 10/1976 Shaffer et al. ..... 220/669
3,987,926 A 10/1976 Yavorsky
D244,832 S * 6/1977 Carter ..... D34/39
4,046,275 A * 9/1977 Virog, Jr. et al. ..... 215/385
4,169,537 A * 10/1979 Sabreen et al. ..... 220/606
4,274,548 A * 6/1981 Schneider ..... 220/675
4,412,628 A * 11/1983 Whitney ..... 220/649
4,579,260 A * 4/1986 Young et al. ..... 222/465.1
4,925,049 A * 5/1990 Pryztulla ..... 220/675
D332,130 S * 12/1992 Przytulla ..... D23/202
5,449,087 A * 9/1995 Mikula et al. ..... 220/608

FOREIGN PATENT DOCUMENTS

DE 9408722 * 11/1994
WO WO95/305585 * 11/1995

* cited by examiner

*Primary Examiner*—Joseph C. Merek
(74) *Attorney, Agent, or Firm*—Henry M. Feiereisen

(57) ABSTRACT

A barrel body with a cross-section surface that approaches the shape of a square with slightly embossed side surfaces and rounded corner areas. The barrel body can be equipped with stiffening elements that run vertically and/or horizontally.

18 Claims, 2 Drawing Sheets

PLASTIC CONTAINER

BACKGROUND OF THE INVENTION

The invention relates to a large-volume container made of thermoplastic material. The container can be designed as a tight-sealed barrel or a barrel with a loose lid with a clamping ring.

Large-volume containers exhibit a capacity (filling volume) of approximately 100 liters or more and are in their tight-sealed barrel embodiment for storing and transporting liquid contents and in the loose lid embodiment preferably for receiving solid, particle-shaped or pasty contents (e.g. rubble, granulate, powders, pastes, etc.).

SUMMARY OF THE INVENTION

The object of the present invention is to provide a generic container, in which, through a change in its design, improved use of the floor space on pallets can be achieved, and also through constructive measures a lessening of the tendency to bulge out.

This object is attained according to the invention, in that the shape of the body of the barrel exhibits one of sectional area approaching the shape of a square with slightly embossed side surfaces and rounded corner areas. Through this measure, better use of the floor space on pallets is achieved. The unused volume of space in between stacked barrels according to the invention is considerably reduced in comparison to traditional round barrels and use of previously unused space volume for freight (e.g. with ISO containers) is increased.

In the design of the invention it is provided that the body of the barrel is equipped with vertically and/or horizontally running stiffening elements, the denting of the flattened side walls is considerably reduced.

The stiffening elements can be designed as open U-shaped or V-shaped rib-like forms that run toward the inside and/or to the outside.

Advantageously, the horizontally running stiffening elements can be designed as molded and thickened mold hoops, for a stable design of the barrel body. Advantageously, the mold hoops are molded during the blow molding of the barrel body through a stamping-out process from the walls of the barrel body. So that the mold hoops exhibit approximately the same exterior diameter as the remaining barrel wall, they can be arranged in an approximately V-shaped mold that rounds around toward and is open toward the outside.

The plastic barrel according to the invention is further distinguished by the following features and advantages:

In an embodiment as a tightly sealed barrel, a central bung piece is located, if necessary, in a die-sunk bung mold, on the upper barrel floor, so that it is protected. In another embodiment, two lateral bung pieces are located in appropriately die-sunk bung house on the upper barrel floor. On the upper circumference of the barrel body, an L-ring is designed as a handling ring. The stiffening elements are U-shaped or V-shaped rib-like molded parts that are open toward the inside and/or toward the outside. The horizontally running stiffening elements are designed as thickened mold hoops molded from the walls of the barrel. The mold hoops are molded from the wall of the barrel body by a stamping-out process during the blow molding of the barrel body. The mold hoops that have been stamped can be arranged in such a way that they run around the circumference in a somewhat V-shaped form, open toward the outside. When only one stiffening ring running around the circumference is provided, then it is located in an area of the barrel body from the middle to the lower third of the barrel body, preferably measured at a height of approximately 43% from the floor of the barrel.

Thus the following advantages are achieved: The stiffness and resistance to denting of the flattened areas of the walls of the barrel and the ease of loading the containers in stacks is overall enhanced.

BRIEF DESCRIPTION OF THE DESCRIPTION

The invention is further explained and described below in the drawings of the embodiments that are presented. The following is shown:

DETAILED DESCRIPTION OF THE INVENTION

Figure 1:
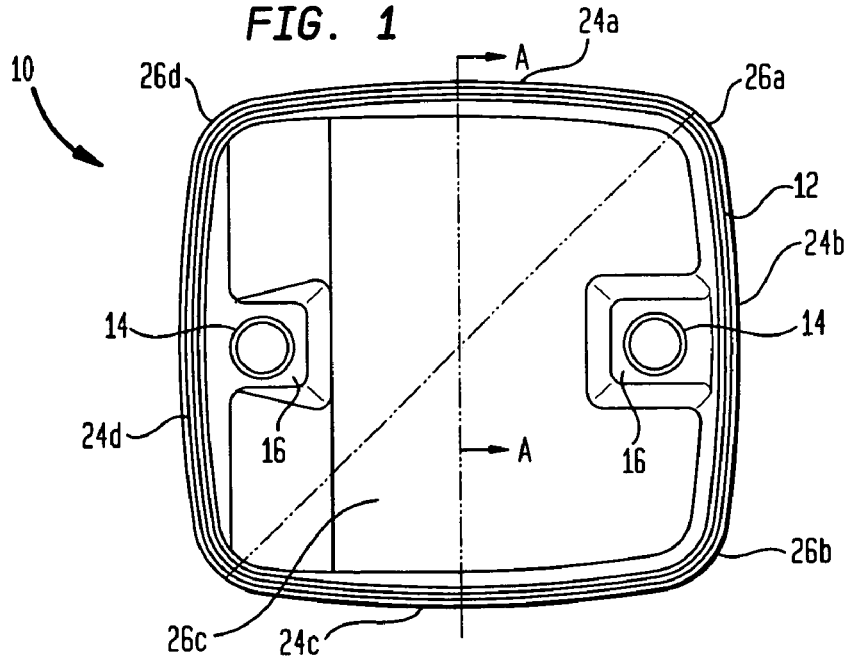
FIG. 1 is a top view of a container according to the invention.

Reference number 10 shows a large-volume blow molded bung barrel made of thermoplastic material in FIG. 1 with a capacity of 250 liters, which is equipped on the upper wall of the container with L-ring 12 that runs around the circumference as a handling hoop. In the top of the barrel are located two side bungs 14 in die-sunk bung molds 16. In this top view, the square-shaped design becomes clear, namely that the barrel bottom exhibits a sectional surface that approximates the shape of a square with side surfaces that are slightly embossed and rounded corner areas.

As seen in the top view of FIG. 1, the barrel body has four substantially identically shaped, outwardly bowed or convex side surfaces 24*a*, 24*b*, 24*c* and 24*d*, each side surface being connected to two adjacent side surfaces at rounded corners 26*a*, 26*b*, 26*c* and 26*d*. The convex side surfaces and the rounded corners impart an approximately square-shaped cross-section to the barrel body which allows better use of floor space on a pallet.

Figure 2:
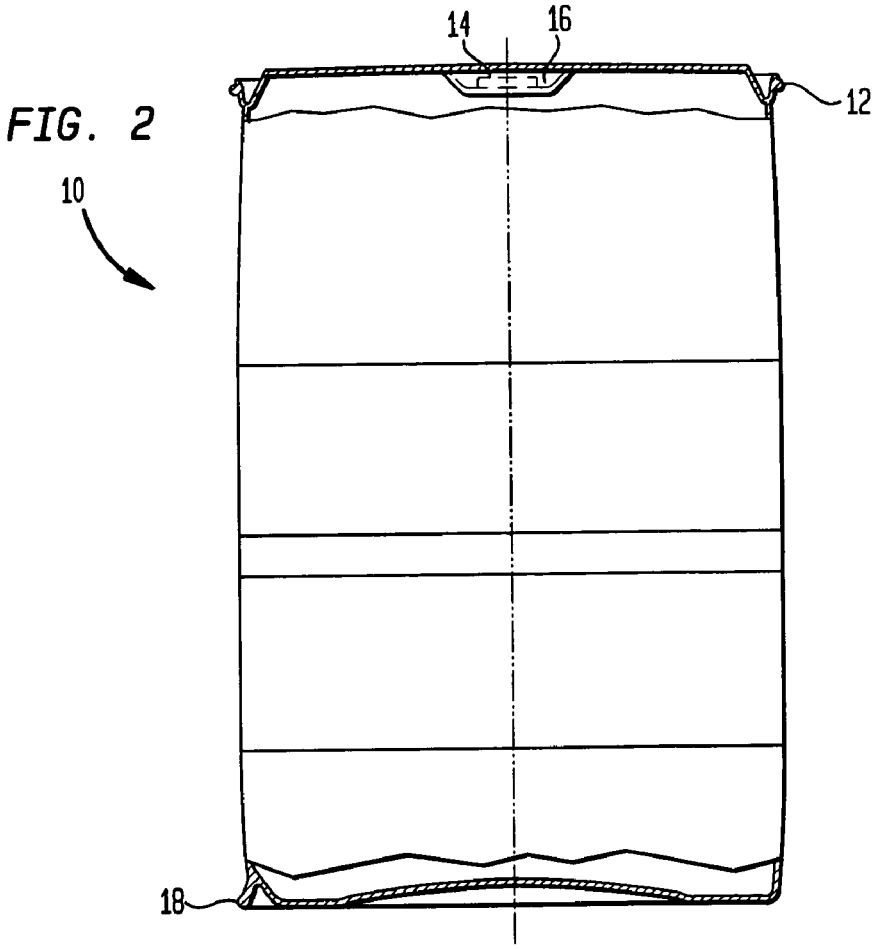
FIG. 2 is a side view of another container according to the invention, with a partial sectional view in the upper and lower area.

FIG. 2 shows an embodiment with a bung 14 centrally located in a bung mold 16. In the left half the picture, the bung barrel 10 is equipped with a foot hoop 18 that runs around the circumference (a hoop that allows it be rolled over the floor), while in the right-half of the picture, another embodiment without a foot hoop is shown.

Figure 3:
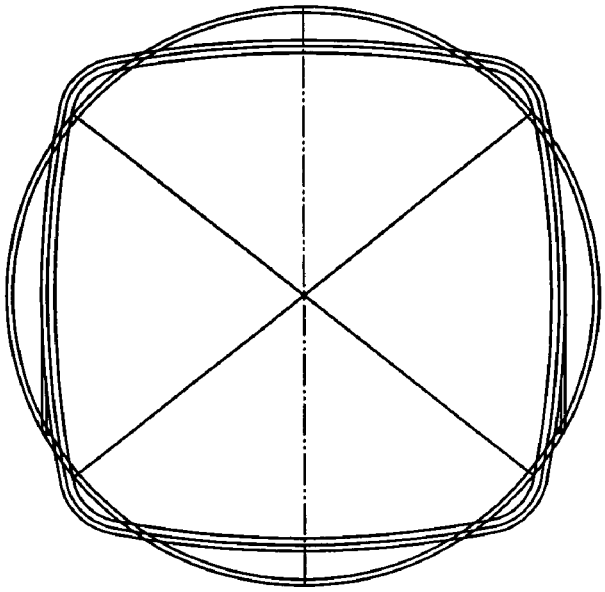
FIG. 3 is a sectional view through the barrel body of a container according to the invention with a circular comparison.
Figure 4:
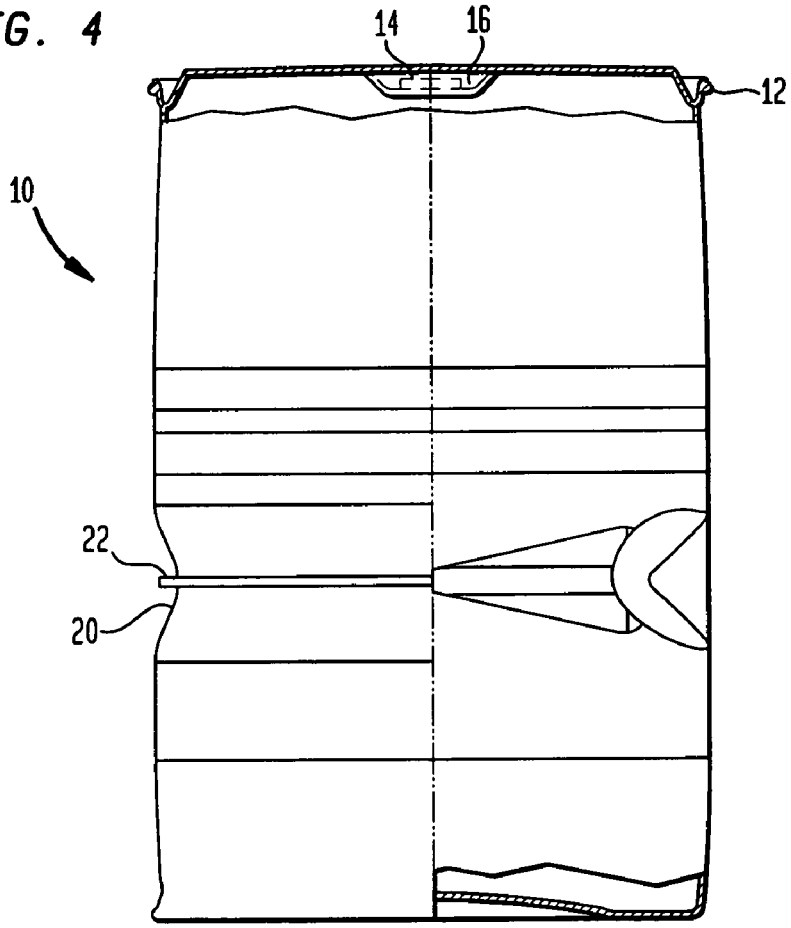
FIG. 4 is a side view of another container according to the invention with a partial section view in the upper and lower area.

FIG. 3 shows a cross-section through the wall of a barrel body according to the invention, which can be designed as a barrel with a loose lid. In comparison to that, a circle with the same circumferential length is superimposed over it. This circle is intended to show the usual bulging-out tendency of a barrel filled with content. Thus the barrel has a tendency to bulge out on the flat areas of the wall and to pull inward in the areas of the corners, and thereby to assume a circular shape as the shape with the least tension. To work against this disadvantageous tendency, the barrel body, as shown at the left side in FIG. 4, is equipped with a mold hoop 22 that runs around its circumference. This mold hoop 22 is measured at a height of about 43% from the floor, is inserted in molded piece 20 in such a way that the circumference of the mold hoop and the rest of the barrel body are approximately the same. The mold hoop can stick out slightly, so that barrels standing next to one another touch one another with their mold hoop. The right side of FIG. 4 shows a molded piece as a stiffening element. Here the molded piece is open toward to outside of the barrel body.

What is claimed is:

1. A plastic blow-molded barrel comprising:

a barrel body having a top surface, a bottom surface, and four substantially identically shaped, convex side surfaces, each side surface connected to two adjacent side surfaces at rounded corners, the bottom surface and four side surfaces having a unitary construction; and a horizontal stiffening element that is formed as an indentation, located between said top surface and bottom surface, and runs along a circumference of the barrel body, wherein the convex side surfaces and the rounded corners impart an approximately square-shaped cross-section to the barrel body.

2. The plastic blow-molded barrel according to claim 1, wherein the top surface, bottom surface, and four side surfaces have a unitary construction.

3. The plastic blow-molded barrel according to claim 1, wherein the horizontal stiffening element is formed as one of a V-shaped indentation and a U-shaped indentation.

4. A plastic blow-molded barrel comprising:

a barrel body having a top surface, a bottom surface, and four substantially identically shaped, convex side surfaces, each side surface connected to two adjacent side surfaces at rounded corners, the bottom surface and four side surfaces having a unitary construction;

a horizontal stiffening element that is formed as an indentation, located between said top surface and bottom surface, and runs along a circumference of the barrel body, and a thickened mold hoop emerging from a radially inner portion of the indentation and extending in a radially outward direction;

wherein the convex side surfaces and the rounded corners impart an approximately square-shaped cross-section to the barrel body.

5. The plastic blow-molded barrel according to claim 4, wherein a radially outermost portion of the mold hoop extends to an outer circumference of the barrel body.

6. The plastic blow-molded barrel according to claim 4, wherein a radially outermost portion of the mold hoop extends beyond an outer circumference of the barrel body so that the mold hoop sticks out from the barrel body.

7. The plastic blow-molded barrel according to claim 4, wherein the thickened mold hoop is provided at a level that is about 43% of a height of the barrel.

8. The plastic blow-molded barrel according to claim 1, further comprising first and second side bungs, each side bung formed on the top surface adjacent to oppositely facing first and second of said four side surfaces.

9. The plastic blow-molded barrel according to claim 1, further comprising a foot hoop extending around a circumference of the barrel body, the foot hoop configured to allow rolling of the barrel on a floor.

10. A plastic barrel comprising:

a barrel body having a top surface, a bottom surface, and four substantially identically shaped side surfaces, each side surface connected to two adjacent side surfaces at corners;

an indentation located between said top surface and bottom surface, and running along a circumference of the barrel body, and a mold hoop emerging from a radially inner portion of the indentation and extending in a radially outward direction.

11. The plastic barrel according to claim 10, wherein the top surface, bottom surface, and four side surfaces have a unitary construction.

12. The plastic barrel according to claim 10, wherein the indentation is formed as one of a V-shape and a U-shape.

13. The plastic barrel according to claim 10, wherein a radially outermost portion of the mold hoop extends to an outer circumference of the barrel body.

14. The plastic barrel according to claim 10, wherein a radially outermost portion of the mold hoop extends beyond an outer circumference of the barrel body so that the mold hoop sticks out from the barrel body.

15. The plastic barrel according to claim 10, wherein the mold hoop is provided at a level that is about 43% of a height of the barrel.

16. The plastic barrel according to claim 10, further comprising first and second side bungs, each side bung formed on the top surface adjacent to oppositely facing first and second of said four side surfaces.

17. The plastic barrel according to claim 10, further comprising a foot hoop extending around a circumference of the barrel body, the foot hoop configured to allow rolling of the barrel on a floor.

18. The plastic barrel according to claim 10, wherein the side surfaces are convex.

* * * * *